US005680999A

United States Patent [19]

Wada

[11] Patent Number: 5,680,999

[45] Date of Patent: Oct. 28, 1997

[54] SHREDDER

[75] Inventor: Toshihiro Wada, Kobe, Japan

[73] Assignee: Kabushiki Kaisha Kinki, Kobe, Japan

[21] Appl. No.: 562,779

[22] Filed: Nov. 27, 1995

Related U.S. Application Data

[63] Continuation of Ser. No. 249,667, May 27, 1994, abandoned, which is a continuation of Ser. No. 47,048, Apr. 12, 1993, abandoned, which is a continuation of Ser. No. 784,875, Oct. 30, 1991, abandoned.

[30] Foreign Application Priority Data

Mar. 8, 1991 [JP] Japan ..... 3-012871
Jun. 14, 1991 [JP] Japan ..... 3-044866

[51] Int. Cl.[6] ..... B02C 18/18

[52] U.S. Cl. ..... 241/236; 241/294; 83/664; 83/840

[58] Field of Search ..... 241/236, 294, 241/295; 83/664, 839, 840

[56] References Cited

U.S. PATENT DOCUMENTS

| | | | |
|---|---|---|---|
| 2,851,917 | 9/1958 | Frew et al. | 83/664 X |
| 3,991,944 | 11/1976 | Baikoff | 241/236 X |
| 4,000,860 | 1/1977 | Gotham | 241/294 X |
| 4,241,882 | 12/1980 | Baikoff | 241/295 X |
| 4,311,284 | 1/1982 | Ratcliff, Jr. | 241/295 X |
| 4,334,650 | 6/1982 | Hardwick et al. | 241/236 |
| 4,349,159 | 9/1982 | Hardwick et al. | 241/236 |
| 4,607,800 | 8/1986 | Barclay | 241/236 X |
| 4,688,731 | 8/1987 | Hunt et al. | 241/294 X |
| 4,801,101 | 1/1989 | Dreyer et al. | 241/294 X |
| 4,901,929 | 2/1990 | Barclay | 241/236 |
| 4,932,596 | 6/1990 | Sullivan et al. | 241/236 |
| 5,141,168 | 8/1992 | Pepper | 241/295 X |
| 5,152,469 | 10/1992 | Dicky | 241/295 X |

FOREIGN PATENT DOCUMENTS

| | | | |
|---|---|---|---|
| 0093223 | 11/1983 | European Pat. Off. . | |
| 0401620 | 12/1990 | European Pat. Off. . | |
| 1059681 | 11/1953 | France | 241/295 |
| 76786 | 6/1977 | Japan | 83/664 |
| 55-41309 | 9/1980 | Japan . | |

*Primary Examiner*—Rinaldi I. Rada
*Assistant Examiner*—Clark F. Dexter
*Attorney, Agent, or Firm*—Marshall, O'Toole, Gerstein, Murray & Borun

[57] ABSTRACT

A shredder comprising a frame, at least two rotatable shafts supported in parallel by the frame, a plurality of cutting blades, each of the blades including a mount which is fixed to one of the shafts and has an outer peripheral side, and a number of tip pieces, each tip piece being fixed to the peripheral side of the mount, and a plurality of spacers mounted on each of the shafts alternately with the blades such that the spacers on each of the shafts are radially aligned with the blades on the other shaft.

2 Claims, 4 Drawing Sheets

SHREDDER

FIELD AND BACKGROUND OF THE INVENTION

This is a continuation of U.S. application Ser. No. 08/249,667, filed May 27, 1994, now abandoned, which is a continuation of application Ser. No. 08/047,048 filed Apr. 12, 1993, now abandoned, which is a continuation of application Ser. No. 07/784,875 filed Oct. 30, 1991, now abandoned.

This invention relates to a shredder for continuously shredding solid materials, such as plastic, wood pieces, paper, metal, rubber, fiber and skin, by effectively utilizing shear force.

This type of shredder is exemplified by Japanese utility model publication S.55-41309, wherein two parallel shafts are supported rotatably through bearings on a casing, and rotate in opposite directions. On each shaft are mounted a plurality of one-piece disc-like cutting blades and spacing collars which alternate with the blades. The blades on one shaft partially overlap with the blades on the other shaft, thereby forming slit cutters.

After a certain period of use the blades become worn, and it is necessary to replace the worn blades with new blades. This is done by disassembling the casing and the bearings and removing the blades together with the spacers from the shafts, which is a very complicated and troublesome work. In addition, because the shredder has a considerable number of cutting blades, the replacement is laborious and the maintenance is not easy.

It is a general object of this invention to provide a shredder having blades which are easy to replace and maintain.

SUMMARY OF THE INVENTION

A shredder according to the invention comprises:

a frame, at least two rotatable shafts supported in parallel by the frame, a plurality of cutting blades, each of said blades including a mount which is fixed to one of the shafts and has an outer peripheral side, and a number of tip pieces, each tip piece being fixed to the peripheral side of the mount, and a plurality of spacers mounted on each of the shafts alternately with the blades such that the spacers on each of said shafts are radially aligned with the blades on the other shaft.

BRIEF DESCRIPTION OF THE DRAWINGS

A preferred embodiment of the invention is shown in the accompanying drawings, wherein.

DETAILED DESCRIPTION OF THE INVENTION

Figure 3:
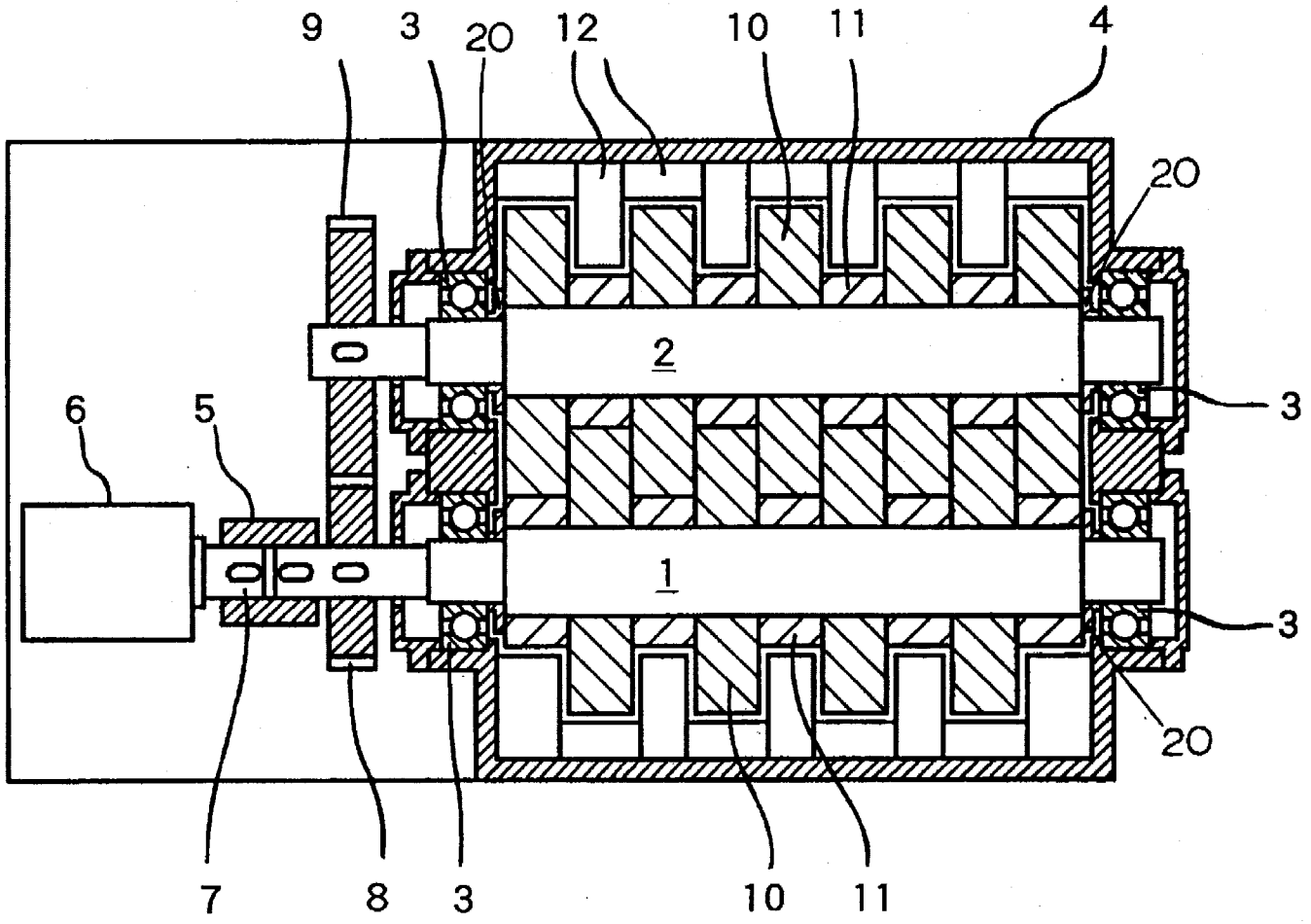
FIG. 3 is a schematic plan view partially in section showing a shredder provided with the blades according to this invention.
Figure 4:
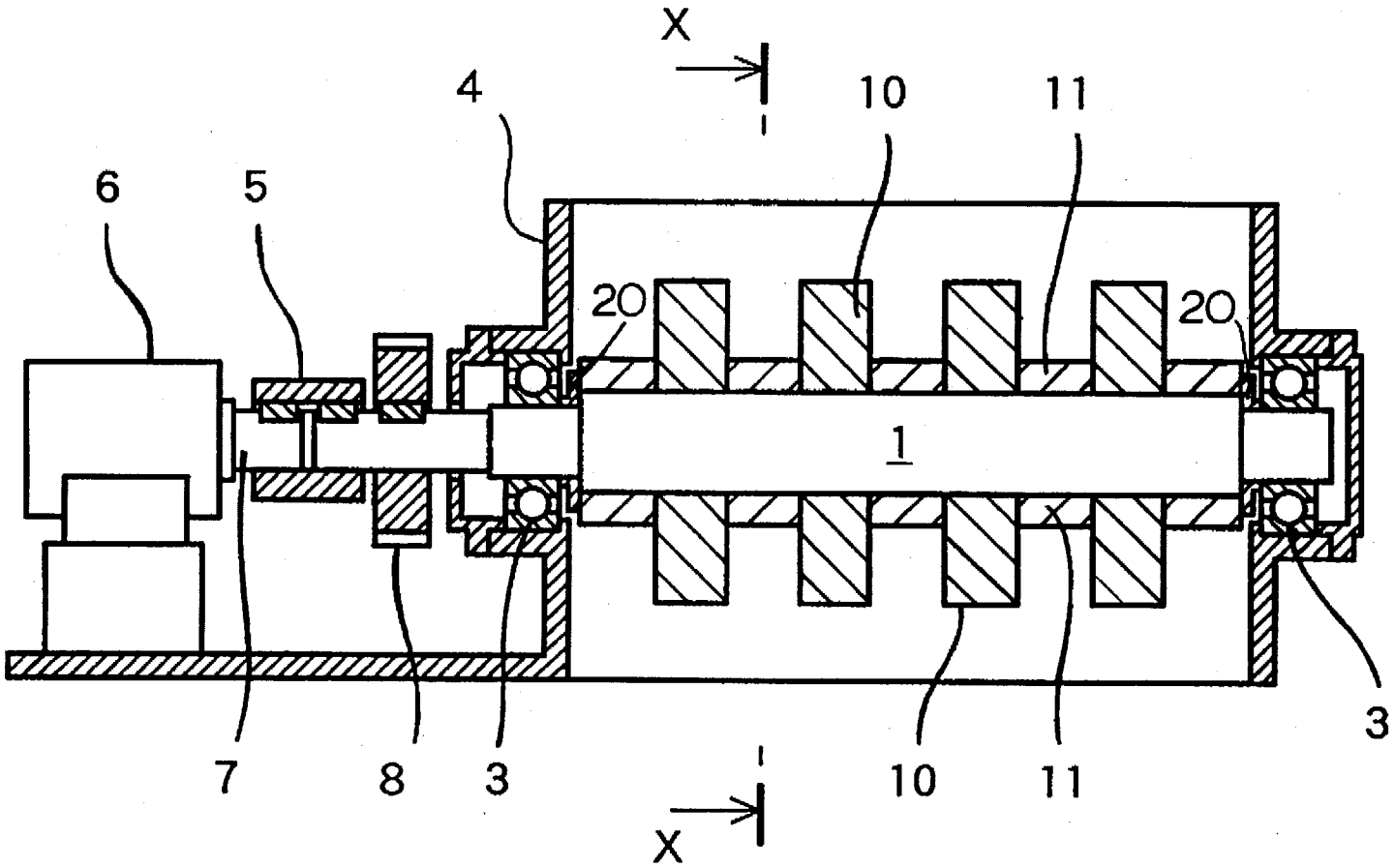
FIG. 4 is a schematic side view partially in section showing the shredder.
Figure 5:
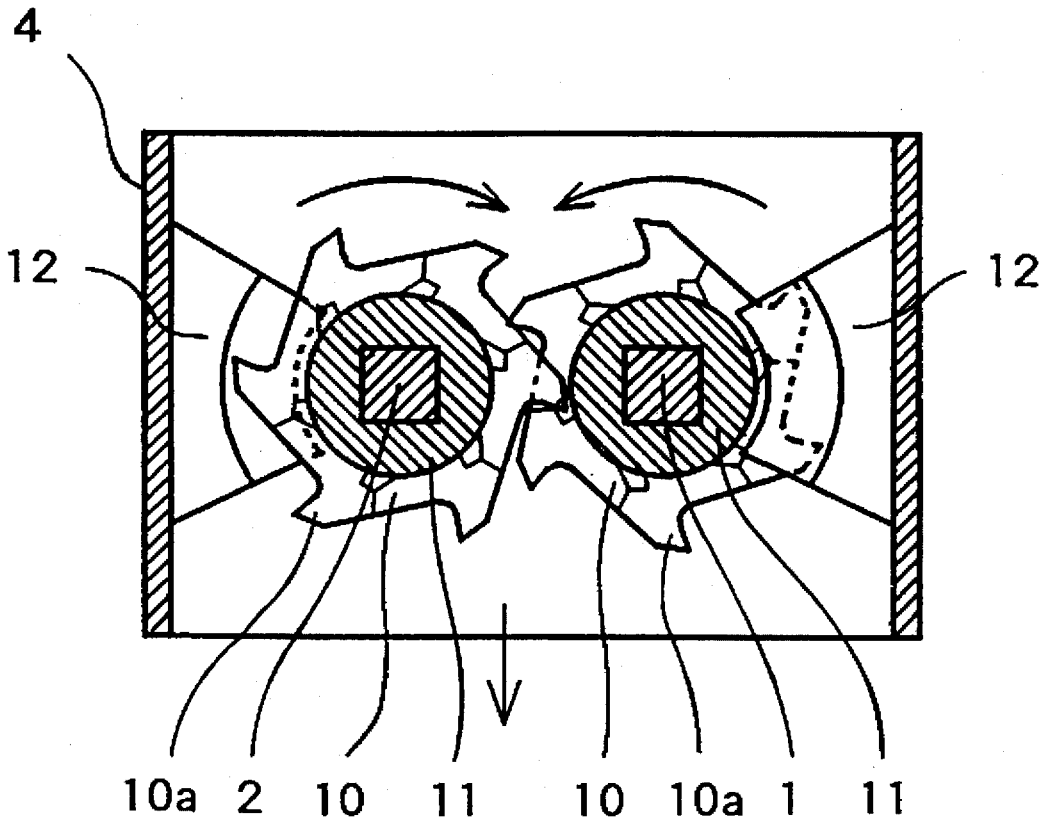
FIG. 5 is a sectional view taken along the line X—X of FIG. 4.

With reference to FIGS. 3–5, apparatus incorporating the invention comprises a main shaft 1 and a driven shaft 2, which extend horizontally in parallel within a casing or frame 4. Both ends of each shaft 1 and 2 are supported through bearings 3 on the end walls of the casing 4. The casing 4 is formed by two vertically extending side walls and the two above-mentioned end walls, which together form a box shape having open top and bottom sides.

The main shaft 1 is coupled at one end through a joint 5 to the drive shaft 7 of a drive motor 6 such as an electric motor, and through two spur gears 8 and 9 to one end of the driven shaft 2. The shafts 1 and 2 are rotated by the motor 6 in the opposite directions shown by the arrows in FIG. 5.

A plurality of disc-like cutting blades 10 and a plurality of spacers 11 are mounted on each of the shafts 1 and 2, on each shaft the blades and spacers being tightly interleaved with each other. The radially extending side surfaces of the blades 10 on one shaft closely overlap with the side surfaces of the blades of the other shaft, thereby forming slit cutters, although there is a small clearance between the side surfaces of adjacent blades to prevent friction during rotation. As shown in FIG. 5, the motor 6 is rotated in the direction to cause the portions of the two sets of blades which are between the two shafts 1 and 2 to move downwardly, whereby material to be shredded may be introduced through the open top side of the casing 4 and discharged through the open bottom side. Since the gear 9 is larger than the gear 8 (see FIG. 3), the shaft 1 will turn faster than the shaft 2, thereby producing a slitting action of material between adjacent blades.

The blades and the spacers are anchored to the shafts so that they rotate together. In the present example, the shafts have a square cross section and the center holes in the blades and the spacers are square, thus causing the blades and the spacers to rotate with the shafts.

Figure 1:
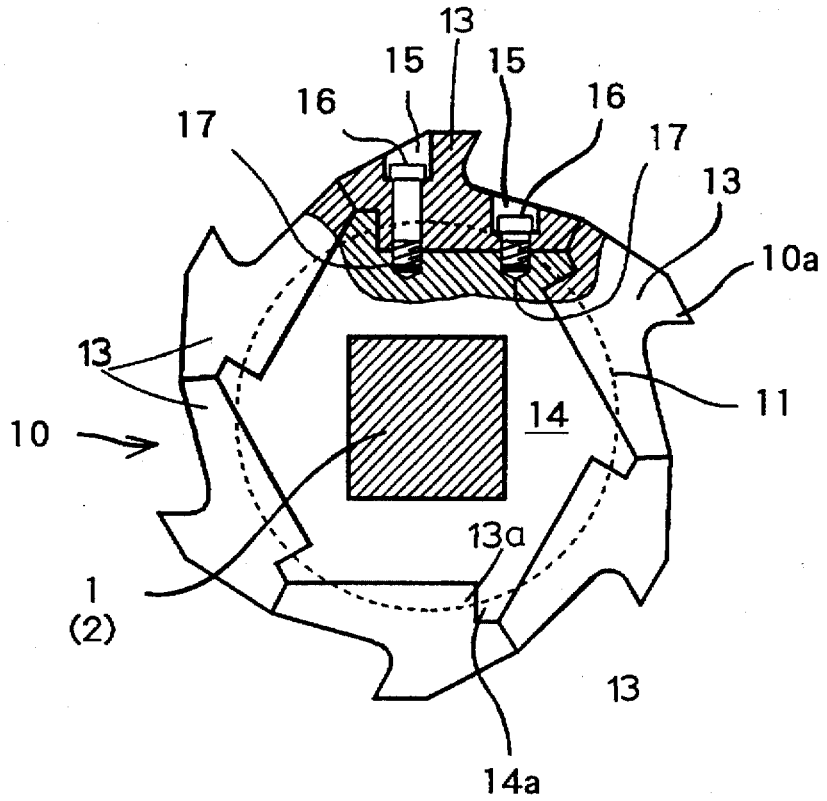
FIG. 1 is a side view partially in section showing a cutting blade according to the invention.

As shown in FIG. 1, each blade 10 includes a mounting part 14, which is fixed to the shaft 1, 2, and a number of tip pieces 13, which surround the mount 14 and each have a tooth 10*a*. The mounting part 14 is polygonal and has teeth 14*a* for engagement with the tip pieces 13.

Each tip piece 13 has bolt holes 15, through which bolts 16 are inserted to engage with threaded holes 17 in the mount 14. The teeth 14*a* extend into recesses or shoulders 13*a* of the tip pieces and thereby securely transmit the torque from the shaft 1, 2 to the tip pieces 13, and bear the reaction force when cutting.

As shown by the dotted circular line in FIG. 1, the spacer 11 has a diameter large enough to substantially protrude radially from the mount 14 and overlap the sides of the tip pieces 13. This secures the tip pieces 13 against axial displacement.

When each pawl 10*a* most closely approaches the outer periphery of opposite spacer 11 on the other shaft, the clearance between them is preferably about 0.5 to 1.0 mm.

Scrapers 12 (FIGS. 3 and 5) are mounted on and project from the side walls of casing 4 toward the blades 10 and spacers 11, and have semicircular ends (FIG. 5) adjacent the tips of pawls 10*a* and the peripheries of spacers 11.

Figure 2:
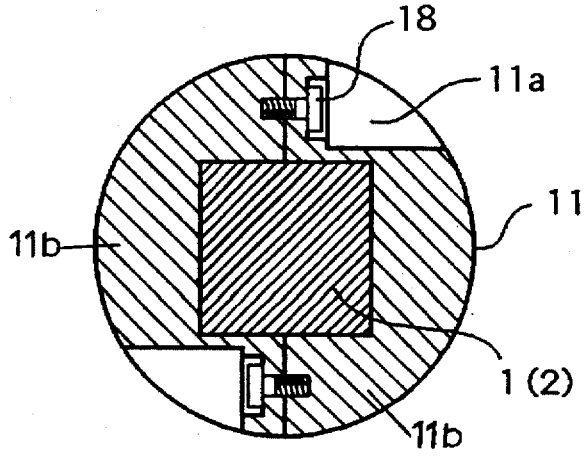
FIG. 2 is a side view in section showing a spacer for use with the blade.

Each spacer 11 is formed by two identical parts 11*b* which extend around opposite sides of a shaft, and the two parts are secured together by screws 18. As shown in FIG. 2, each part 11*b* engages one full side and parts of two additional sides of the shaft, thereby enhancing the torque transfer from the shaft to the part.

With reference to FIGS. 3 and 4, the stack or assembly of the spacers and the blades are held together by collars 20 which fit between the bearings 3 and the stack.

In use, material is thrown from above into the open upper side of the casing 4 and drawn in by the pawls 10*a*. It is then shredded by the shearing of the slit cutters to have a length equivalent to the interval or spaces between the pawls 10*a*, and is discharged downwardly.

Because the outer periphery of each mount 14 is completely surrounded by the tip pieces 13, only the tip pieces 13 wear. The worn pieces 13 can be replaced by simply removing the bolts 16, without the necessity of disassembling the casing 4 and the bearings 3 in order to remove the blades 10 from the shaft 1, 2.

The outer peripheries of spacers 11 also easily wear. By removing the bolts 18, a spacer 11 can be easily removed from the shaft 1, 2 and replaced.

What is claimed is:

1. Cutting apparatus for use in a shredder including two counter rotating shafts supported in parallel by a frame, a plurality of cutting blades and a plurality of spacers alternately fixed along each shaft such that one of the cutting blades on one shaft is aligned with one of the spacers of the other shaft, wherein each of said cutting blades comprises a mounting member and a plurality of tip pieces separately attached on the radial peripheral surface of the mounting member, the improvement comprising:

(a) said mounting member of each of said cutting blades having engaging means on its outer periphery for imparting rotational force to said tip pieces;

(b) said tip pieces substantially surrounding said mounting member outer periphery, said tip pieces being identical to each other and each of said tip pieces being separately fastened to said mounting member with separate removable first fastening members which extend generally radially through said tip pieces and into said mounting member, each of said fastening members being separately removable substantially radially, and each of said tip pieces being separately removable substantially radially in the absence of said first fastening means, whereby said tip pieces are separately and independently removable from said mounting member;

(c) side surfaces of each of said mounting members and said tip pieces attached thereto are radially aligned, and said spacer abutting said side surfaces of said mounting member and said tip pieces, whereby said spacer axially supports said tip pieces;

(d) each of said spacers being formed by at least two spacer parts and second removable fastening means for securing said spacer parts together, said two spacer parts substantially surrounding the outer periphery of said shaft, said spacer parts being separately removable substantially in a direction radially away from said shafts in the absence of said second fastening means, whereby said shafts are surrounded and protected from wear by said removable tip pieces and said removable spacers; and (e) wherein said mounting member has a polygonal outer periphery and said engaging means comprises outwardly extending teeth on said outer periphery of said mounting member, and each tip piece having a recess receiving said teeth.

2. Cutting apparatus as set forth in claim 1, wherein said shafts have a square configuration with four peripheral surfaces, and said parts forming said spacer comprise two identical parts, each of said parts having three engaging surfaces engaging three of said four peripheral surfaces of said shaft.

* * * * *